US005664275A

United States Patent [19]

Sebor

[11] Patent Number: 5,664,275

[45] Date of Patent: Sep. 9, 1997

[54] VIBRATORY OSCILLATOR SWIMMING POOL CLEANER EMPLOYING MEANS FOR FACILITATING SELF STARTING AND FOR AVOIDING CLOGGING

[76] Inventor: Pavel Sebor, 751 Cricklewood Ter., Heathrow, Fla. 32746

[21] Appl. No.: 307,938

[22] Filed: Sep. 16, 1994

Related U.S. Application Data

[63] Continuation-in-part of Ser. No. 880,665, May 11, 1992, Pat. No. 5,371,910, Ser. No. 131,318, Oct. 4, 1993, Pat. No. 5,386,607, and Ser. No. 978,237, Nov. 18, 1992, Pat. No. 5,404,607, which is a continuation-in-part of Ser. No. 882,662, May 11, 1992, abandoned, Ser. No. 880,663, May 11, 1992, Pat. No. 5,259,258, Ser. No. 880,664, May 11, 1992, Pat. No. 5,303,444, Ser. No. 880,665, May 11, 1992, Pat. No. 5,371,910, Ser. No. 880,666, May 11, 1992, Pat. No. 5,274,868, Ser. No. 880,667, May 11, 1992, Pat. No. 5,285,547, Ser. No. 880,668, May 11, 1992, Pat. No. 5,259,082, and Ser. No. 880,669, May 11, 1992, Pat. No. 5,261,287, said Ser. No. 131,318, is a continuation of Ser. No. 880,662, May 11, 1992.

[51] Int. Cl.[6] ..... E04H 4/16

[52] U.S. Cl. ..... 15/1.7; 251/175; 92/125; 137/527; 137/527.8

[58] Field of Search ..... 15/1.7, 404, 419; 137/110, 112, 527.8, 527.6, 527; 251/175, 176, 59, 85; 92/125

[56] References Cited

U.S. PATENT DOCUMENTS

| | | | |
|---|---|---|---|
| 1,591,903 | 7/1926 | White | 251/175 |
| 1,860,619 | 5/1932 | Pfau | 251/175 |
| 3,023,741 | 3/1962 | O'Connor | 121/99 |
| 3,481,250 | 12/1969 | Toby | 91/232 |
| 4,023,227 | 5/1977 | Chauvier | 15/1.7 |
| 4,133,068 | 1/1979 | Hofman | 15/1.7 |
| 4,208,752 | 6/1980 | Hofmann | 15/1.7 |
| 4,351,077 | 9/1982 | Hofmann | 15/1.7 |
| 4,692,956 | 9/1987 | Kassis | 15/1.7 |

FOREIGN PATENT DOCUMENTS

| | | |
|---|---|---|
| 0 476 413 A2 | 2/1991 | European Pat. Off. . |
| 767648 | 5/1934 | France . |
| 557312 | 10/1957 | France . |

*Primary Examiner*—Gary K. Graham

*Attorney, Agent, or Firm*—Allen, Dyer, Doppelt, Franjola & Milbrath, P.A.

[57] ABSTRACT

A cleaner for swimming pools includes a housing having a pressure differential chamber with an opening defined by opposing walls and an oscillator pivotally mounted within the opening on a pivot axis extending between the walls. A seal is loosely fitted within a recess along a side of the oscillator for movement outwardly across a gap between the oscillator and the wall of the opening to close the gap when necessary for purposes of starting the oscillator and for opening the gap when required to allow grit, leaves and the like to pass through.

20 Claims, 4 Drawing Sheets

VIBRATORY OSCILLATOR SWIMMING POOL CLEANER EMPLOYING MEANS FOR FACILITATING SELF STARTING AND FOR AVOIDING CLOGGING

STATEMENT OF RELATED APPLICATIONS

This application is related to the following:

a) As a continuation-in-part of application Ser. No. 07/880,665 filed on May 11, 1992 for "Sliding Oscillator Seal For a Submersible Suction Cleaner", now U.S. Pat. No. 5,371,910 b) as a continuation-in-part of application Ser. No. 08/131,318 filed on Oct. 4, 1993 for "Ground Engaging Means For a Submersible Cleaning Device", now U.S. Pat. No. 5,386,607, which is a continuation of application Ser. No. 07/880,662 filed on May 11, 1992; and c) as a continuation-in-part of application Ser. No. 07/978,237 filed on Nov. 18, 1992 for "Self-Propelled Submersible Suction Cleaner and Method", now U.S. Pat. No. 5,404,607, which in turn is a continuation-in-part of the following:

1) application Ser. No. 07/882,662 filed on May 11, 1992 for "Ground Engaging Means For a Submersible Cleaning Device", now abandoned;

2) application Ser. No. 07/880,663 filed on May 11, 1992 for "Friction Clutch Drive For a Submersible Cleaning Device", now U.S. Pat. No. 5,259,258;

3) application Ser. No. 07/880,664 filed on May 11, 1992 for "Rigid Skirt For Bristles of Submersible Suction Cleaner", now U.S. Pat. No. 5,303,444;

4) application Ser. No. 07/880,665 filed on May 11, 1992 for "Sliding Oscillator Seal For a Submersible Suction Cleaner", now U.S. Pat. No. 5,371,910;

5) application Ser. No. 07/880,666 filed on May 11, 1992 for "Elevation Limiter For Submersible Suction Cleaner", now U.S. Pat. No. 5,274,868;

6) application Ser. No. 07/880,667 filed on May 11, 1992 for "Internal By-Pass Valve For Submersible Suction Cleaner", now U.S. Pat. No. 5,285,547;

7) application Ser. No. 07/880,668 filed on May 11, 1992 for "Mechanism For Dislodging a Submersible Cleaning Device From a Surface", now U.S. Pat. No. 5,259,082; and 8) application Ser. No. 07/880,669 filed on May 11, 1992 for "Positive Engagement Clutch For a Submersible Cleaning Device", now U.S. Pat. No. 5,261,287.

BACKGROUND OF THIS INVENTION

This invention relates to self-propelled swimming pool cleaners.

Prior to November 1989, Mr. Pavel Sebor conceived of and built prototypes for a swimming pool cleaner having a motor using a vibratory oscillator. In November 1989 at Orlando, Fla. Mr. Sebor disclosed his vibratory oscillator pool cleaner prototypes to Mr. Dieter Rief in confidence and granted to Mr. Rief certain rights to develop the vibratory motor into a working device. Mr. Sebor and Mr. Rief entered into a related written agreement on Sept. 10, 1990.

Between November 1989 and November 1990, Mr. Rief built approximately 20–30 prototypes of swimming pool cleaners using Mr. Sebor's vibratory oscillator motor. In December, 1990 in Orlando, Mr. Rief disclosed in confidence one of his later prototypes to a prospective manufacturer. While Mr. Rief's prototypes at that time cleaned certain areas of a swimming pool into which it was placed, the prototypes were unable to consistently move from the deep end of the pool to the shallow end, and were unable to climb from the bottom of the pool onto a vertical wall. Representatives of the prospective manufacturer explained to Mr. Rief that these technical deficiencies would preclude the design of these prototypes from becoming a commercially viable pool cleaner.

Mr. Rief's later prototypes also suffered from an inability to be self-starting under all circumstances, and would frequently become jammed with the leaves or grit often found in swimming pools.

This patent is directed to certain technical improvements developed by Mr. Sebor to solve the problems noted above with respect to the self-starting and jamming difficulties of swimming pool cleaners using Mr. Sebor's vibratory oscillator design.

DESCRIPTION OF THE PRIOR ART

Mr. Rief's early prototypes incorporating Mr. Sebor's vibratory motors as described above are the subject of U.S. Pat. No. 5,293,659.

Other prior art of interest includes the following U.S. Pat. Nos.: 1,591,903 to White; 1,860,619 to Pfau; 2,108,183 to Sjobig; 4,023,227 to Chauvier; 4,208,752 to Hofmann; 4,351,077 to Hofmann; and 3,023,741 to O'Connor. See also, French patent 557,312 to Hennion.

SUMMARY OF THE INVENTION

According to Mr. Sebor's vibratory motor invention as discussed in the afore-mentioned U.S. Pat. No. 5,293,659, a self-propelled submersible suction cleaner includes a housing with a pressure differential chamber having an oscillator pivotally mounted for to and fro movement within the pressure differential chamber to effectuate a forward motion. In order to be self-starting, Mr. Sebor has determined that the edges of the oscillator must suitably seal against the side walls of the pressure differential chamber. However, to insure proper operation under all conditions, Mr. Sebor has also determined that the oscillator and at least one of the pressure differential chamber walls should be separable during operation in order to open a gap between the oscillator and the wall to allow grit and the like to pass through.

In a preferred arrangement according to this invention, the oscillator operates with a gap between at least one edge of the oscillator and one of the chamber walls, the oscillator having sealing means extending between the edge of the oscillator and the pressure differential chamber wall to close the gap, the sealing means being slidably mounted on the oscillator so as to be able to retract from the chamber wall to thereby open the gap between the oscillator and the wall to permit the grit and other debris through.

In this preferred arrangement, the oscillator has retaining means along either edge thereof (and preferably both edges) and an elongated seal member located in the slot, the seal member being free to slide outwardly from its retaining means to engage the chamber wall or to be forced inwardly into the retaining means to open the gap between the edge of the oscillator and the chamber wall. In order to facilitate the sliding of the seal member outwardly against the chamber wall, at least a portion of the retaining means slot on the upstream side relative to fluid flow is open to expose at least a portion of the sealing member. In one arrangement, the exposed portion of the sealing member also includes a lateral gripping formation, or slide bar, fixed to the sealing member in order to permit the sealing member to be both manually manipulated and to also enhance the responsiveness of the sealing member to fluid flow.

As is illustrated at FIG. 5*a* of Mr. Sebor's earlier application Ser. No. 07/978,237, it is also preferred that the retaining means (i.e., a slot) into which the sealing member is inserted is substantially oversize with respect to the dimensions of the sealing member, in order that the sealing member fits loosely therein to reduce the likelihood that the sealing member will be subjected to seizure from the accumulation of dirt or grit between the sealing member and the walls of the slot. Because the seals are loose, there is no braking effect caused by the seals when the oscillator starts. When the seals are drawn against the chamber walls, the water passes across the edges lateral to the sealed edges, thereby increasing power and efficiency.

The manner in which vibratory oscillator swimming pool cleaners employing Mr. Sebor's sliding seal construction in order to facilitate self starting and to avoid clogging will be better understood with reference to the accompanying drawing and the following description.

THE DRAWING

Figure 8:
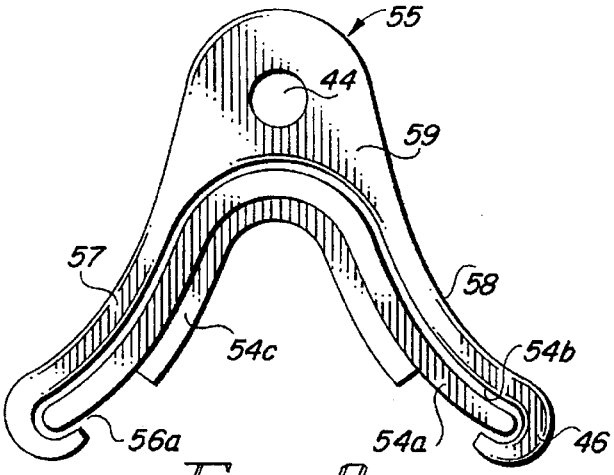
Figure 9:
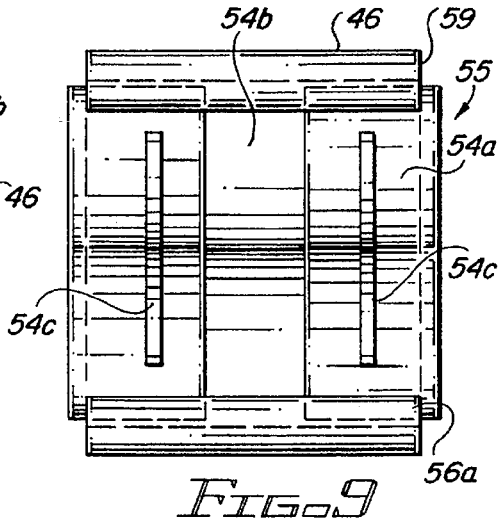
Figure 11:
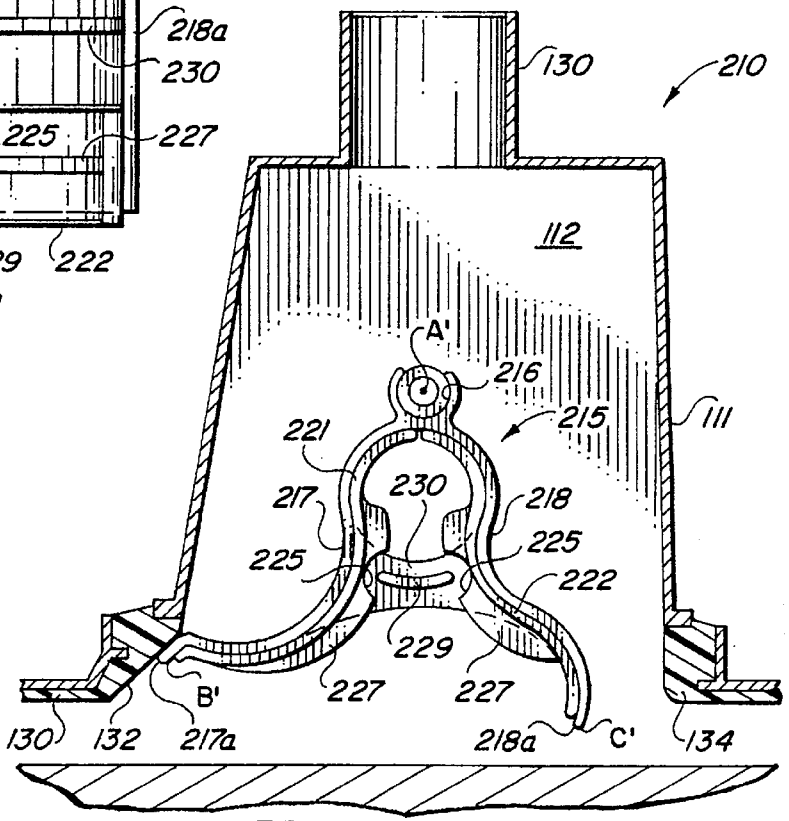
Figure 12:
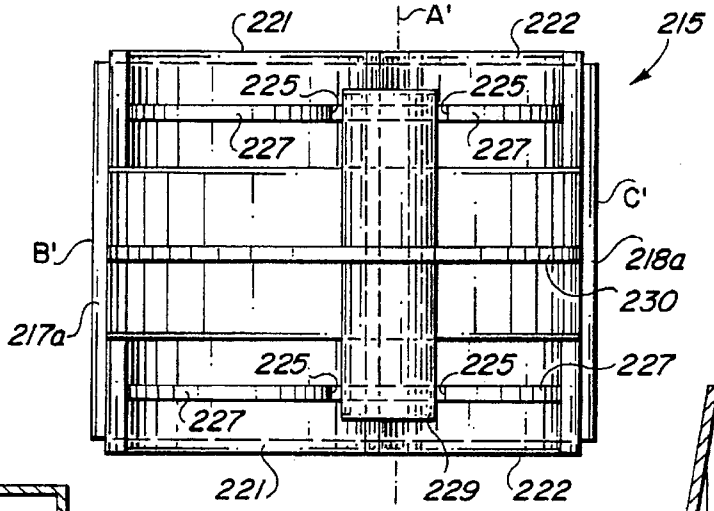
Figure 10:
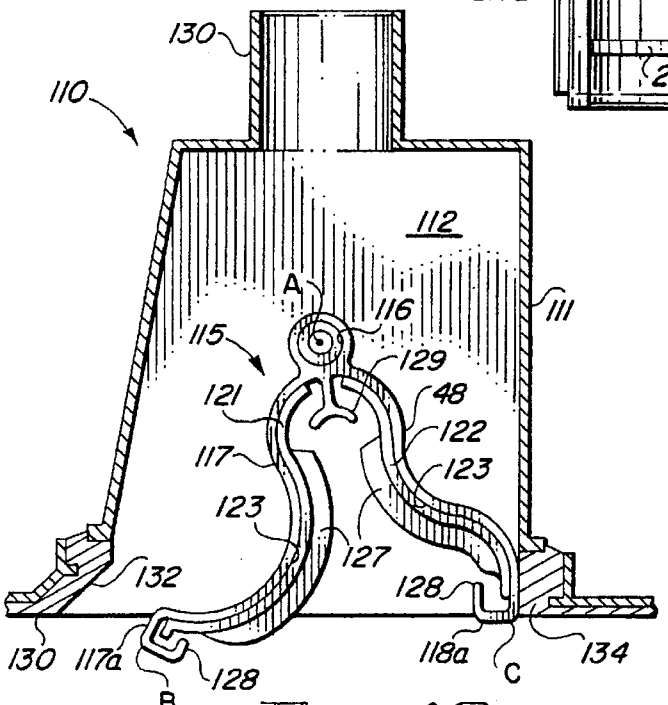

FIGS. 8 and 9 are side and bottom views, respectively, of a bell-shaped version of Mr. Sebor's vibratory oscillator employing a sliding seal construction and correspond to FIGS. 5*a* and 5*b* in the afore-mentioned application Ser. No. 07/978,237, which drawings and accompanying description are incorporated herein by reference;

FIG. 10 is a side view of a first asymmetrical embodiment of Mr. Sebor's vibratory oscillator employing a sliding seal construction according to the present invention; and FIGS. 11 and 12 are side and bottom views, respectively, of a second asymmetrical embodiment of Mr. Sebor's vibratory oscillator using another form of a sliding seal retainer according to the present invention.

DETAILED DESCRIPTION

Figure 1:
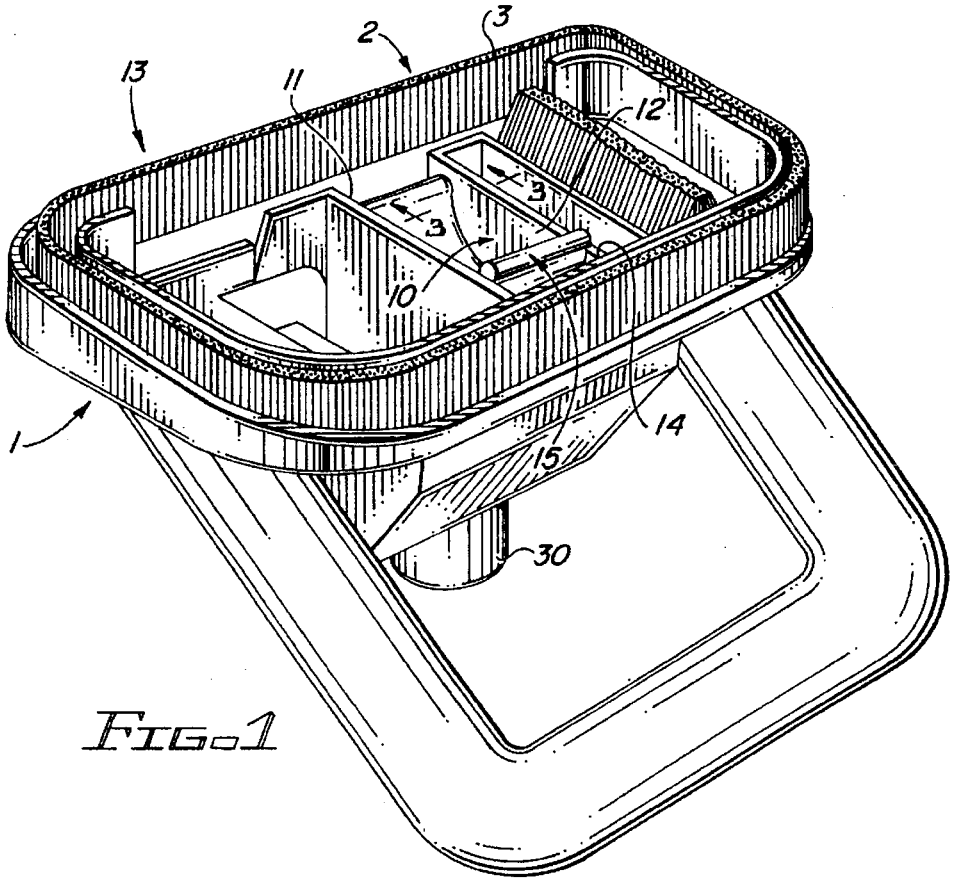
FIG. 1 is a perspective view of the lower side of a suction cleaner housing according to Mr. Sebor's invention.
Figure 2:
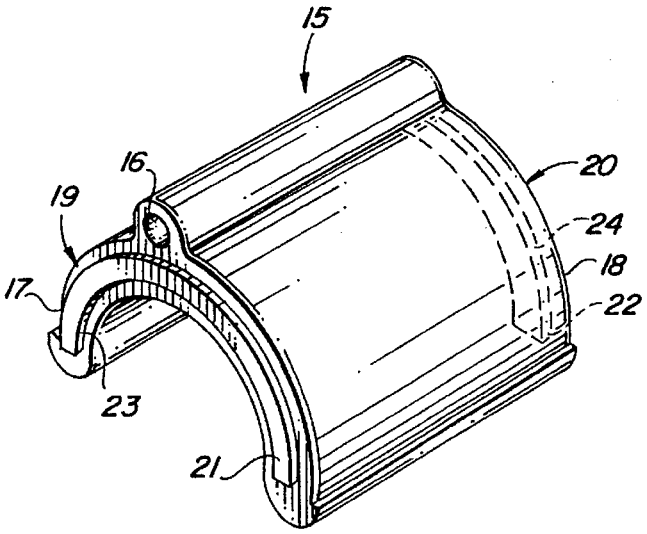
FIG. 2 is a perspective view of an oscillator removed from the housing of FIG. 1 and incorporating a sliding seal construction.
Figure 3:
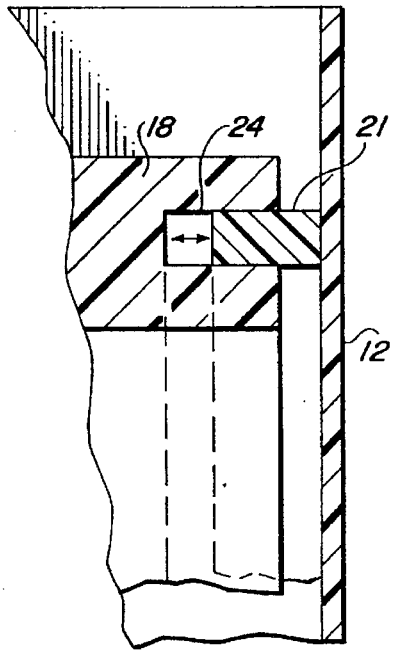
FIG. 3 is a section taken along the line 3—3 of FIG. 1.

Referring to FIGS. 1—3 of the drawings, a self-propelled suction cleaner housing 1 includes a mouth 2 along which bristles 3 are disposed so that the head rests on the bristles in its operative position.

The housing 1 incorporates a pressure differential chamber 10 within the housing which pressure differential chamber is defined by side walls 11 and 12 and end walls 13 and 14.

An oscillator 15 is pivotally mounted within the pressure differential chamber on a hinge pin (not shown) extending through a boss 16 on the oscillator, the hinge pin being journalled on the side walls 11 and 12, the pin and boss, defining a pivot axis between the side walls.

A connector 30 is provided on the housing 1 for a suction hose (not shown) used to connect the housing to a filter pump of a swimming pool. Coupling the housing to the filter pump causes flow into the pressure differential chambered 10 via the mouth of the housing and the flow impinges the arcuate sides 17 and 18 of the oscillator 15, causing the oscillator to swing to and fro on its hinge pin and imparting a vibratory motion to the housing. An angular disposition of the bristles 3 causes the head to advance in-stepwise fashion in response to the vibratory motion.

It will be appreciated that the efficiency of the operation of the oscillator depends at least in part on the strength of flow over the arcuate sides 17 and 18. If this flow is dissipated around the edges 19 and 20 of the oscillator 15 between the latter and the walls 11 and 12, the strength of the flow over the surfaces 17 and 18 will be diminished with a consequent drop in the efficiency of the vibratory motion of the oscillator. In some circumstances, the oscillator 15 may not be self-starting.

In order to prevent such dissipation of the flow energy and to ensure that the oscillator 15 is self-starting under essentially all conditions, one arrangement is to dimension the oscillator so that its sides are closely located between the side walls 11 and 12 so that little flow is dissipated. In this event, however, grit, leaves and other debris drawn into the pressure differential chamber 10 are liable to lodge between the oscillator and the side walls 11 and 12, thereby causing a loss of efficiency of the oscillator through friction, or the oscillator may even become stuck.

In accordance with the present invention the oscillator 15 and pressure differential chamber 10 are designed so that the edges 19 and 20 are suitably spaced a distance from the side walls 11 and 12 of the pressure differential chamber to enable grit to pass easily therethrough. Retractable sealing means 21 and 22 are provided at edge of the oscillator to seal the gap between the edges 19 and 20 of the oscillator and the side walls 11 and 12 respectively of the pressure differential chamber. The sealing means 21 and 22 comprise arcuate sealing members each located in a corresponding retaining means, for example slot 23 and 24, in the respective edges 19 and 20 of the oscillator 15.

Figure 4:
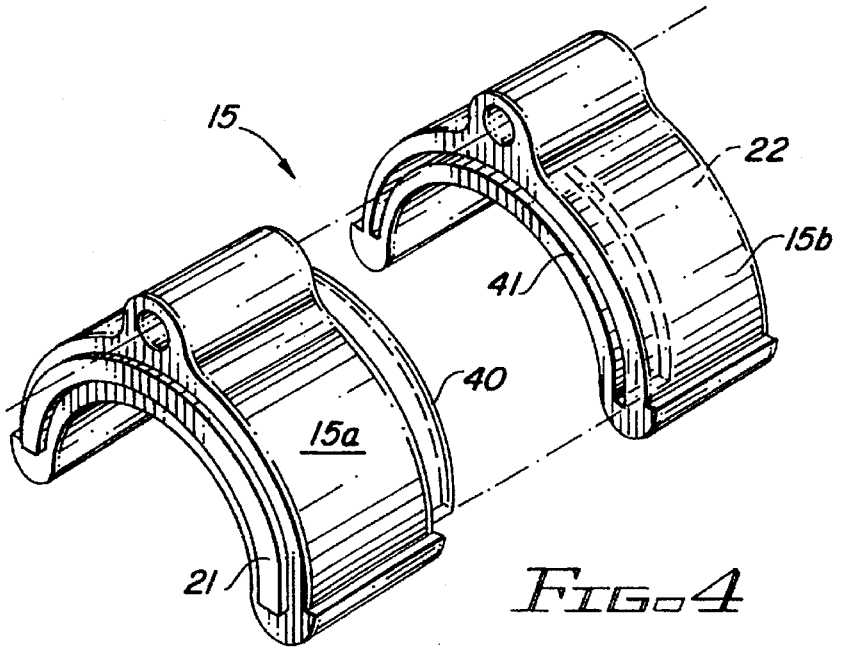
FIG. 4 is a perspective view of an oscillator providing an alternative form of sliding seal according to the invention.

Thus when the housing 1 is coupled to the filter pump and water is caused to flow around the oscillator 15 in the pressure differential chamber 10, the sealing means 21 and 22 are drawn outwardly from the slots 23 and 24 in a direction parallel with the pivot axis into sealing engagement with the walls 11 and 12 of the pressure differential chamber. Under normal operation and especially during the initiation of oscillator operation, the engagement between the sealing means 21 and 22 and the walls 11 and 12 causes minimal friction and little impairment of the efficiency of the oscillator 15. In the event that grit, leaves or debris finds its way between the sealing means 21 and 22 and the walls 11 and 12, the sealing means are simply forced to retract into the slots 23 and 24, allowing the grit, etc. to easily pass through the pressure differential chamber Referring now to FIG. 4, it will be seen that in an alternative arrangement the oscillator 15 is split into two sections 15*a* and 15*b*. Oscillator section 15*a* has a tongue 40 which is slidable into and out of groove 41 in the oscillator section 15*b* into an overlapping relationship.

In this case the sealing means 21 and 22 on the outer edges of the oscillator are fixed. In the event that grit finds its way between sealing means 21 and 22 and walls 11 and 12 of the pressure differential chamber, the tongue 40 of oscillator section 15*a* is simply forced to retract into groove 41 of oscillator section 15b thereby opening a gap between sealing means 21 and 22 and walls 11 and 12 of the pressure differential chamber and allowing the grit easily to pass through the pressure differential chamber into the filter.

Figure 5:
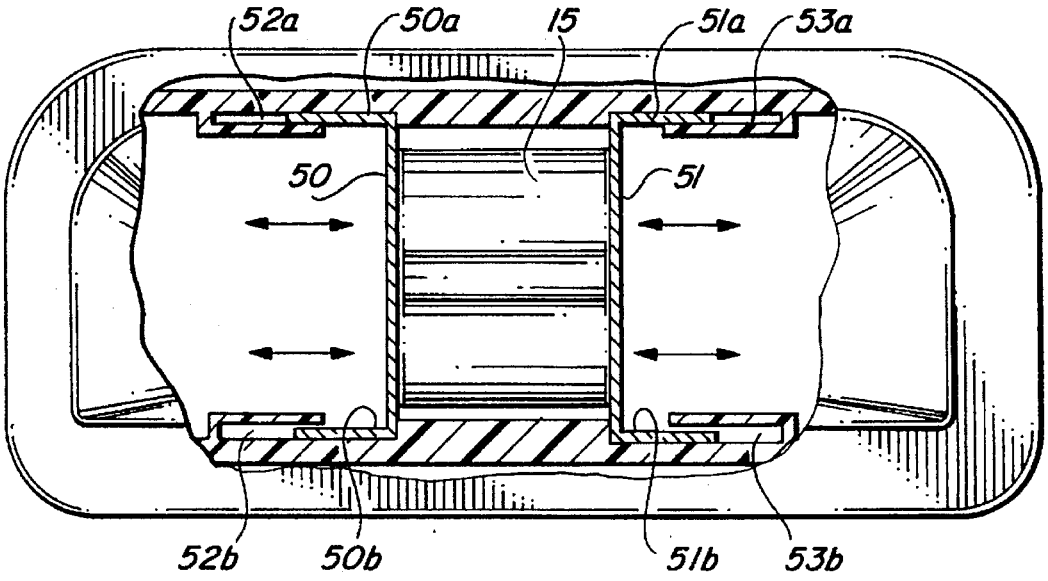
FIG. 5 is a plan view partly in section of a further alternative form of a sliding seal.

Referring now to FIG. 5 a second alternative is provided in the form of a pressure differential chamber having side walls 50 and 51 mounted so as to allow end sections 50a and 50b and 51a and 51b to be slidable into and out of guide tracks 52a, 52b and 53a, 53b, respectively. Under normal conditions the side walls are drawn against the oscillator 15c by the suction created within the pressure differential chamber. However, should grit enter between the oscillator 15 and the walls 50 and 51 the latter simply retract into the guide tracks 52a, 52b and 53a, 53b allowing the grit to pass through the pressure differential chamber 10.

A first example of Mr. Sebor's sliding seal construction will now be described with reference to FIGS. 6 and 7, where like reference numerals are used to identify the same elements as those depicted in FIGS. 1–3 and described above.

Figure 6:
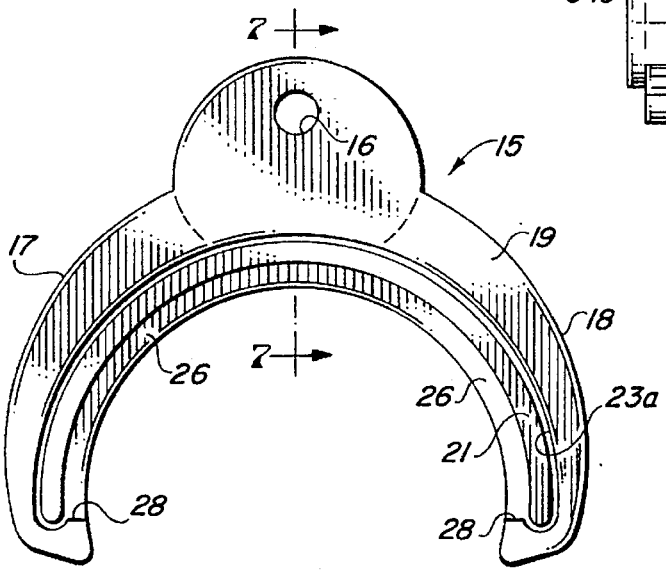
FIG. 6 is a side view illustrating a first construction of Mr. Sebor's oscillator utilizing the sliding seal technique.
Figure 7:
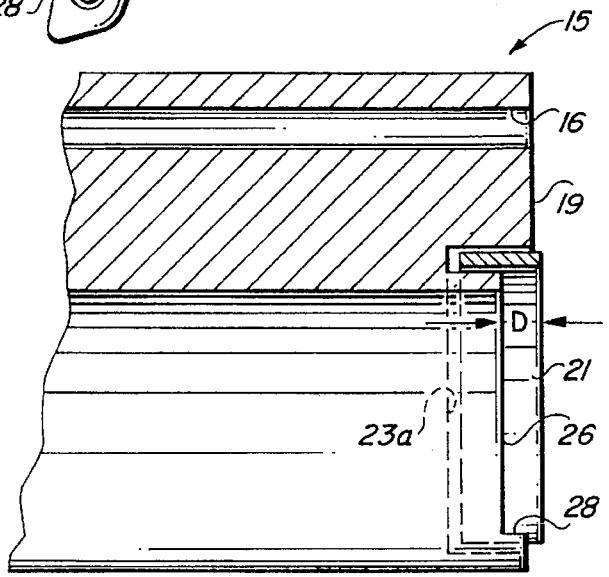
FIG. 7 is a partially cut-away cross section of the construction of FIG. 6, taken along the lines 7—7.

Noting FIGS. 6 and 7, the oscillator 15 is provided with a recess 23a along its respective edges, including side edge 19, which recess 23a is equivalent to the slot 23 of FIGS. 1–3. The sliding member 21 is fitted into the recess 23a, and the side edge 19 includes a portion within the arcuate form of the oscillator side 15 which is drawn back away from the plane of the side edge 19 a distance represented by a dimension "D" shown in FIG. 7 to form a second edge surface 26 spaced from the plane of the side edge 19 by that dimension, and thereby expose a forward portion of the sliding member 21.

The recessed surface 26 terminates short of the extremities of the sides 17, 18 of the oscillator 15 at respective retainer surfaces 28, the retainer surfaces serving to retain the arcuate sliding members 21 within the corresponding recess 23a. (Note FIG. 7).

An alternate form of the vibratory oscillator and the associated sealing means is depicted in FIGS. 8 and 9 and described with reference thereto. Noting FIG. 8, the oscillator element 55 has a generally bell-shaped configuration, that is in which the outside surfaces 57, 58 are concave in contrast to the convex surfaces 17, 18 shown in FIG. 2. The oscillator 55 includes a recess 54b which conforms to the shape of the oscillator 55 along an end 59 thereof, with a conforming sliding member 54a fitted within the recess 54b. As depicted in FIG. 9, the recess 54b extends entirely across the inside surface of the oscillator 55 , but likewise includes a retaining extension 56a on both sides thereof. Gripping formations or slide bars 54c extend laterally from each of the sliding members 54a. As is shown in FIG. 8, the recess 54b is substantially oversized with respect to the sliding members 54a, so that the sliding members loosely fit within the recess 54b. In operation, the slide bars 54c further insure that the sliding members 54a properly respond to the fluid flow across the oscillator 55.

Another example of the sliding seal construction is depicted in the cross-sectional side view of FIG. 10, described next.

In FIG. 10, the pressure differential cleaner 110 includes a housing 111 and an internal pressure differential chamber 112 with an asymmetrical oscillator 115 mounted in the pressure differential chamber 112 on pivot axis 116. In the specific form of the oscillator 115 shown in FIG. 10, the oscillator includes a forward side 117 Which is substantially longer between the pivot axis 116 and the forward extremity 117a of that side with respect to the opposing side 118, relative to the dimension between the pivot axis 116 and the extremity 118a of that second side. The oscillator 115 includes an oversize opening 123 defined by retaining tabs 128 at the lower extremity and an upper retaining member 129 adjacent the pivot axis 116. A pair of sliding seal members 121 and 122 are provided on the respective insides of the sides 117, 118 of the oscillator 115. Each of the sliding seal members 121, 122 includes a slide bar 127 extending laterally from the inside surface, in the same manner as the slide bar 54c of FIG. 9. The construction of the asymmetrical oscillator 115 and chamber 112 as shown in FIG. 10 achieves the following advantages: a larger gap at the forward extremity 117a; greater dynamic force in the forward direction extending forwardly from the forward side 117; a partially upward force against surface 132; and an easier intake of water, grit and other debris through the larger gap between extremity 117a and surface 132 (especially if surface 132 is angled relative to the surface across which the cleaner is travelling). It will also be appreciated that the dimension between points A and B is greater than between points A and C.

In the construction of cleaner 110 in FIG. 10, there is provided opposing buffer elements 130, 134 of a resilient material such as polyurethane plastic. In the embodiment of FIG. 10, the forward buffer member 130 has an angular surface 132, the angularity of which may, for example, be on the orders of between 30°–60° relative to the surface across which the cleaner 110 is travelling. The angular surface 132 is engaged by the end extremity 117a.

A second form of the asymmetric oscillator arrangement of the present invention is shown in FIGS. 11 and 12, where like reference numerals and letters refer to the same element as is shown and described with reference to FIG. 10.

In FIGS. 11 and 12, the asymmetrical oscillator 215 comprises forward and rearward sides 217 and 218 which respectively terminate at ends 217a and 218a. In contrast to the arrangement of FIG. 10, there is not provided retaining tabs (as tabs 128 in FIG. 10) for retaining the seal members. In the arrangement of FIGS. 11 and 12, the segmented seal members 221 and 222 (for which there are opposing pairs on opposite sides of the oscillator 215 as shown in FIG. 12) are retained in place through the inclusion of a retaining member 229 which extends laterally across the inside space of the oscillator 215, as is shown in FIG. 12. The retaining member 229 is suspended in that open space via a brace 230 extending between the opposing sides 217, 218 of the oscillator 215. To avoid the necessity for the retaining tabs at the extremity of the sides 217 and 218 and otherwise hold the seal members 221, 222 within the inside space of the oscillator 215, each seal member 221, 222 is provided with a laterally-extending slide bar 227 each of which is provided with a curved opening 225 adjacent the retaining member 229 to thus segment the slide bar 227. It will thus be appreciated that when the oscillator 215 is not subjected to the flow of water through the chamber 112, then the seal members 221, 222 fall downwardly, until the upper tab portion of the slide bar 227 engages the retaining member 229. Thereafter, when the submersible cleaner 210 is subjected to the flow of water passing through the chamber 112, each of the seal members 221, 222 are pushed upwardly into engagement with the inside surface of each of the sides 217, 218, and are also pushed outwardly into engagement with the opposing side walls of the chamber 112, in the manner which has been described above with reference to FIGS. 1–9.

This concludes the description of the preferred embodiments. A reading by those skilled in the art will bring to mind various changes without departing from the spirit and scope of the invention. It is intended, however, that the invention only be limited by the following appended claims.

What is claimed is:

1. A submersible cleaner for swimming pools comprising:

a housing including a chamber therein having an opening defined by opposing walls through which opening water flows during operation of the cleaner;

an oscillator having opposing ends and pivotally mounted in the opening of the housing on a pivot axis extending between the opposing walls for continuous oscillatory movement to and fro within the opening responsive to the flow of water across the ends of the oscillator, the oscillator including a first side facing a first one of the walls with a gap therebetween;

sealing means slidably fitted with the first side of the oscillator and slidable outwardly in a direction generally parallel with the pivot axis into engagement with the first wall; and wherein the sealing means is at least partially exposed to the flow of water through the chamber.

2. The submersible cleaner recited in claim 1 wherein the sealing means extends along the side of the oscillator at least to one of the opposing ends thereof.

3. The submersible cleaner recited in claim 2 wherein the sealing means extends along the side of the oscillator to both of the opposing ends.

4. The submersible cleaner recited in claim 3 wherein the portion of the sealing means exposed to flow of water extends to both of the opposing ends.

5. The submersible cleaner recited in claim 4 further comprising means at each of the opposing ends of the oscillator for retaining the sealing means with the oscillator.

6. The submersible cleaner recited in claim 5 wherein the retaining means is substantially oversized with respect to the sealing means, so that the sealing means loosely fits within the retaining means.

7. The submersible cleaner recited in claim 6 wherein the retaining means and the sealing means conform to the cross-sectional shape of the oscillator between the opposing ends.

8. The submersible cleaner recited in claim 7 further comprising a slide bar extending laterally from the sealing means and exposed to the flow of water to assist the sealing means in sliding outwardly across the gap in response to fluid flow.

9. A submersible cleaner for swimming pools comprising:

a housing including a chamber having an opening defined by opposing walls through which opening water flows during operation of the cleaner;

an oscillator having opposing ends, the oscillator pivotally mounted in the opening on a pivot axis between the walls for oscillatory movement to and fro within the opening responsive to the flow of water across the oscillator, the oscillator including a first side facing one of the walls of the opening and having retaining means extending generally parallel with the pivot axis;

sealing means slidably fitted with the retaining means adjacent the first side of the oscillator and alternately slidable inwardly and outwardly in a direction generally parallel with the pivot axis and into and out of engagement with the one wall of the housing; and wherein the retaining means is substantially oversized with respect to the sealing means, such that the sealing means fits loosely within the retaining means in order to insure that the functioning of the sealing means is not impeded by grit and other material.

10. The submersible cleaner recited in claim 9 wherein the sealing means extends outwardly to the opposing ends of the oscillator and conform to the shape thereof, the oscillator further including means at each of the opposing ends for holding the sealing means in the retaining means.

11. The submersible cleaner recited in claim 9 wherein the sealing means includes an outer face exposed to the flow of water impinging upon the oscillator, the water thereby urging the sealing means outwardly across the gap between the side of the oscillator and the walls of the opening.

12. The submersible cleaner recited in claim 11 further comprising a lateral slide bar extending from the exposed face of the sealing means for further facilitating the movement of the sealing means outwardly across the gap in response to the flow of water impinging upon the oscillator.

13. The submersible cleaner recited in claim 9 wherein the oscillator is generally semi-cylindrical in cross section.

14. The submersible cleaner recited in claim 9 wherein the oscillator is generally bell-shaped in cross section.

15. The submersible cleaner recited in claim 9 wherein the oscillator is generally asymmetrical in cross section.

16. The submersible cleaner recited in claim 15 wherein the dimension between the pivot axis and one of the oscillator ends is greater than the dimension between the pivot axis and the other oscillator end.

17. The submersible cleaner recited in claim 16 further comprising means for defining the direction of travel as forwardly from the side of the oscillator having the longer dimension between the pivot axis and the one oscillator end.

18. A submersible cleaner for swimming pools comprising:

a housing including a chamber having an opening defined by opposing walls through which opening water flows during operation of the cleaner;

an oscillator having opposing ends, the oscillator pivotally mounted in the opening on a pivot axis between the walls for oscillatory movement to and fro within the opening responsive to the flow of water across the oscillator, the oscillator including a first side facing one of the walls of the opening;

sealing means slidably fitted adjacent the first side of the oscillator and alternately slidable inwardly and outwardly in a direction generally parallel with the pivot axis and into and out of engagement with the one wall of the housing; and wherein the oscillator includes retaining means at each of the opposing ends thereof for holding the sealing means into slidable engagement with the oscillator.

19. The submersible cleaner recited in claim 18 wherein the oscillator is generally semi-cylindrical in cross section and wherein the sealing means is also generally semi-cylindrical in cross section in conformity with the cross sectional shape and dimension of the oscillator.

20. The submersible cleaner recited in claim 18 wherein the sealing means comprises a plastic material having low frictional characteristics.

* * * * *